US005452634A

United States Patent [19]

Wilson

[11] Patent Number: 5,452,634

[45] Date of Patent: Sep. 26, 1995

[54] DIE ROLL AND AIR MANIFOLD SYSTEM

[76] Inventor: Matthew A. Wilson, 1315 S. Vandeventer, St. Louis, Mo. 63110

[21] Appl. No.: 167,513

[22] Filed: Dec. 14, 1993

[51] Int. Cl.[6] ..... B26D 1/62; B26D 7/18

[52] U.S. Cl. ..... 83/99; 83/98; 83/346

[58] Field of Search ..... 83/24, 98, 99, 83/346, 669; 137/624.13, 625.16; 492/4

[56] References Cited

U.S. PATENT DOCUMENTS

| | | | |
|---|---|---|---|
| 2,085,435 | 6/1937 | Lohmann | 83/98 |
| 3,747,449 | 7/1973 | Gould | 83/98 |
| 3,766,814 | 10/1973 | Kesten | 83/99 |
| 3,945,280 | 3/1976 | Roncato | 83/98 |

*Primary Examiner*—Eugenia Jones
*Assistant Examiner*—Charles Goodman
*Attorney, Agent, or Firm*—Senniger, Powers, Leavitt & Roedel

[57] ABSTRACT

A die roll and air manifold system comprising a rotary die roll rotatable in a press, and an air manifold having a cylindric body positioned in a central bore in the die roll. The cylindric body of the air manifold has an outside diameter only slightly less than the diameter of the bore. A pair of shafts extend coaxially from opposite ends of the cylindric body beyond respective ends of the die roll for mounting of the air manifold and die roll on a press. The manifold shafts have outside diameters less than the diameter of the central bore in the die roll and less than the outside diameter of the cylindric body of the air manifold. Axial passaging in the air manifold is provided for connection at its inlet end to a source of pressurized air. One or more air outlet passages in the body of the air manifold extend from this axial passaging to the outer surface of the manifold body. These passages are positioned for intermittent alignment with radial outlet passages in the die roll as the die roll rotates relative to the air manifold thereby to effect the intermittent delivery of bursts of pressurized air through the air outlet passages in the die roll to remove scrap material from cutters on the outer surface of the die roll.

13 Claims, 5 Drawing Sheets

F
67
83
39
43
A1
69
9
65
5
71
35
75
73
63
61
13
3
1
4
31
41
51
37
53
15
11
17
21
7
95
97
45
A2

DIE ROLL AND AIR MANIFOLD SYSTEM

SUMMARY OF THE INVENTION

This invention relates generally to die cutting apparatus and, more particularly, to an air manifold system for ejecting scrap material from the die cutters of a rotary die roll to prevent clogging of the cutters.

When using a die roll to cut a pattern in a web of material (to make labels, for example), pieces of scrap cut from the web will become lodged in the die cutters. If this scrap is not removed periodically during operation of the die, the die cutters will be severely damaged. One conventional method of removal is to blow the material out of the die cutters by delivering intermittent bursts of air to the cutters. This has heretofore been accomplished by supplying pressurized air to a "probe" (a perforated length of metal or plastic tubing) removably positioned in a central longitudinal bore in the die roll and held stationary by suitable clamps on the press. As the die roll rotates relative to the probe, pressurized air exits through holes in the probe and travels through radial air passages in the die roll. The arrangement is such that intermittent bursts of air are delivered through the radial passages to eject scrap material from the die cutters on the outer surface of the roll.

The air "probe" system described above has several drawbacks. First, the fit of the cylindric probe in the bore of the die roll is relatively loose, either because the original parts are not closely toleranced, or because of wear, or both. This loose fit results in a reduction in the air pressure available for the delivery of intermittent bursts of air to the die cutters via the radial air passages in the die roll, sometimes to the point where the bursts are of insufficient force to eject pieces of scrap clogging the die cutters. Also, because the fit of the probe in the die roll is loose, air may be delivered to the air passages in the die roll on an indiscriminate basis, causing scrap to be blown off the die roll in uncontrolled directions. It should be noted in this regard that it is generally preferable that the air bursts be delivered only to air passages in the die roll which are pointing in a selected direction as the die roll rotates so that scrap is not ejected where it may interfere with adjacent machinery or operations.

Still another disadvantage of the conventional air "probe" system is that the maximum diameters of the central bore in the die roll and the removable probe disposed therein are restricted by the size of the mounting shafts at the ends of the die roll. These shafts are integrally formed as one piece with the die roll and cannot exceed press specifications. As a result, the maximum diameters of the central bore and probe are relatively small, which limits the number of air passages that can be formed in the die roll in any given radial plane. Since each die cutter on the die roll requires its own air passage(s) for the supply of intermittent air bursts to the cutter, this limitation also reduces the number of die cutters which can be placed in any given radial plane. This makes it difficult if not impossible to cut certain very intricate patterns requiring closely spaced die cutters.

Among the several objects of this invention may be noted the provision of an improved air "probe" system in which the diameter of the bore in the body of the die roll, and the diameter of the probe (referred to herein as an air manifold), are increased significantly to permit closer spacing of the die cutters on a die roll in any given radial plane; the provision of such a system in which the probe (air manifold) has a close tolerance fit inside the bore of the die roll to reduce the indiscriminate escape of air into the bore and thereby maximize the strength of the air bursts delivered through the air passages in the die roll to ensure the ejection of scrap material from the die cutters; the provision of such a system in which the delivery of air to the die cutters takes place only when the cutters are in a predetermined position so that scrap material is ejected from the cutters in a controlled fashion; the provision of such a system which is durable for reducing press downtime and replacement of parts; and the provision of such a system which is relatively economic to manufacture.

Briefly, a die roll and air manifold system of the present invention comprises a rotary die roll rotatable in a press about a central longitudinal axis. The die roll has a central cylindric longitudinal bore generally coaxial with said axis, and a generally cylindric outer surface concentric with the bore, the outer surface being adapted for rolling engagement with a web of material to be die cut. A plurality of cutters are provided on the outer surface of the roll, each of the cutters having a cutting edge formation defining a substantially closed loop for cutting out a piece of the web to be removed from the web as scrap. Air outlet passages in the die roll extend generally radially outwardly from said central longitudinal bore to locations on the outer surface of the roll inside the substantially closed loops defined by the cutting edge formations of respective cutters. The system also includes an air manifold having a cylindric body positioned in the central bore in the die roll. The cylindric body has an outside diameter only slightly less than the diameter of the bore. A pair of shafts extend coaxially from opposite ends of the cylindric body beyond respective ends of the die roll for mounting of the air manifold and die roll on a press, the die roll being rotatable relative to the air manifold. The manifold shafts have outside diameters less than the diameter of the central bore in the die roll and less than the outside diameter of the cylindric body of the air manifold. Axial passaging in the air manifold extends generally axially of the manifold. The passaging has an inlet adapted for connection to a source of pressurized air. One or more air outlet passages in the body of the air manifold extend from the axial passaging to the outer surface of the manifold body. The air outlet passages are positioned for intermittent alignment with each of the air outlet passages in the die roll as the roll rotates relative to the air manifold thereby to effect the intermittent delivery of bursts of pressurized air through the air outlet passages in the die roll. These bursts of air serve to eject the aforesaid scrap pieces of web from the cutters.

The present invention is also directed to an improved air manifold system as described above adapted for use in connection with a rotary die roll as described above.

Other objects and features will be in part apparent and in part pointed out hereinafter.

BRIEF DESCRIPTION OF THE DRAWINGS

Corresponding reference characters and numerals indicate corresponding parts throughout the several views of the drawings.

DETAILED DESCRIPTION OF THE PREFERRED EMBODIMENT

Figure 1:
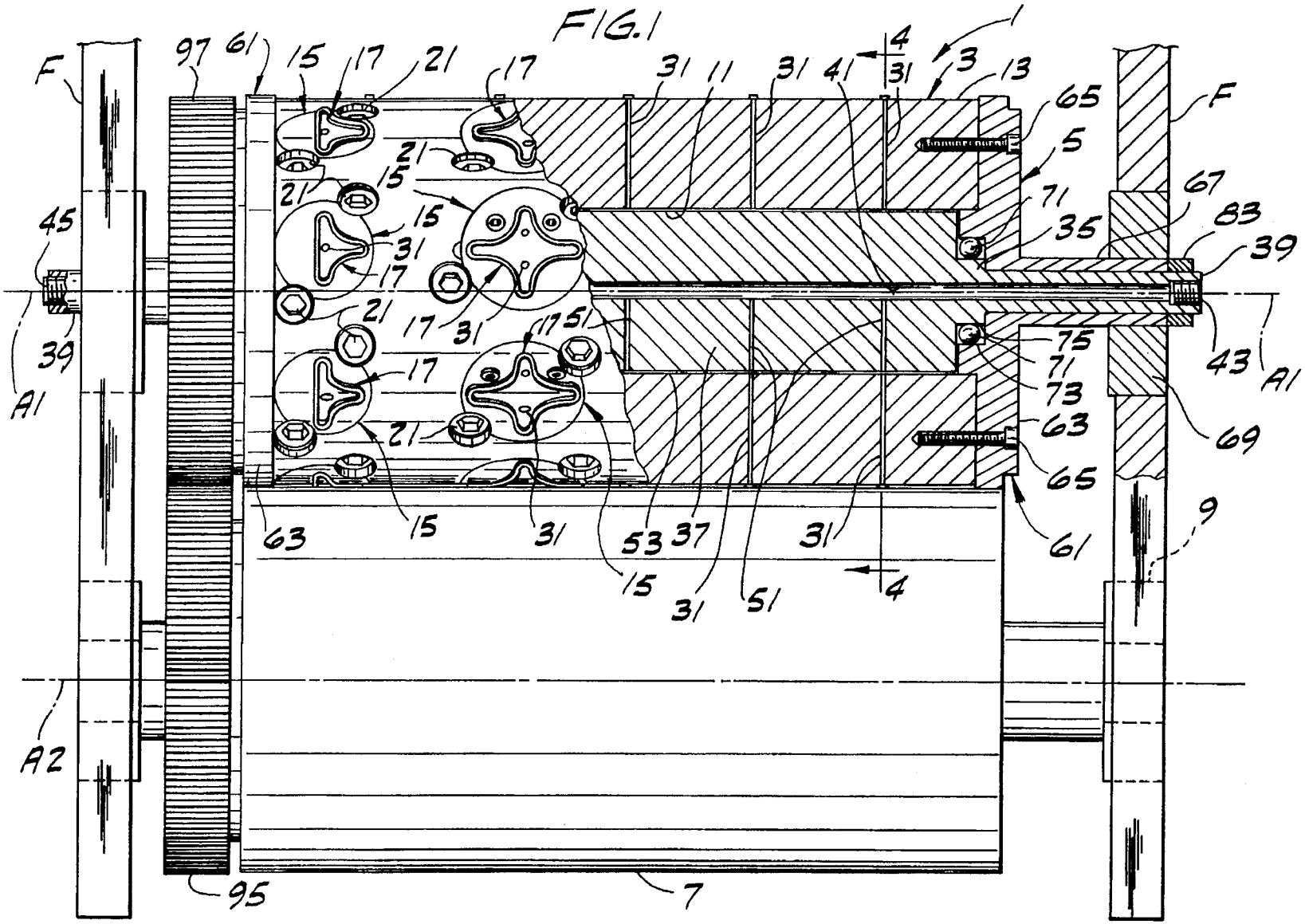
FIG. 1 is an elevational view of a die roll and air manifold system of the present invention shown mounted on a press, parts of the system being shown in section to illustrate details.
Figure 3:
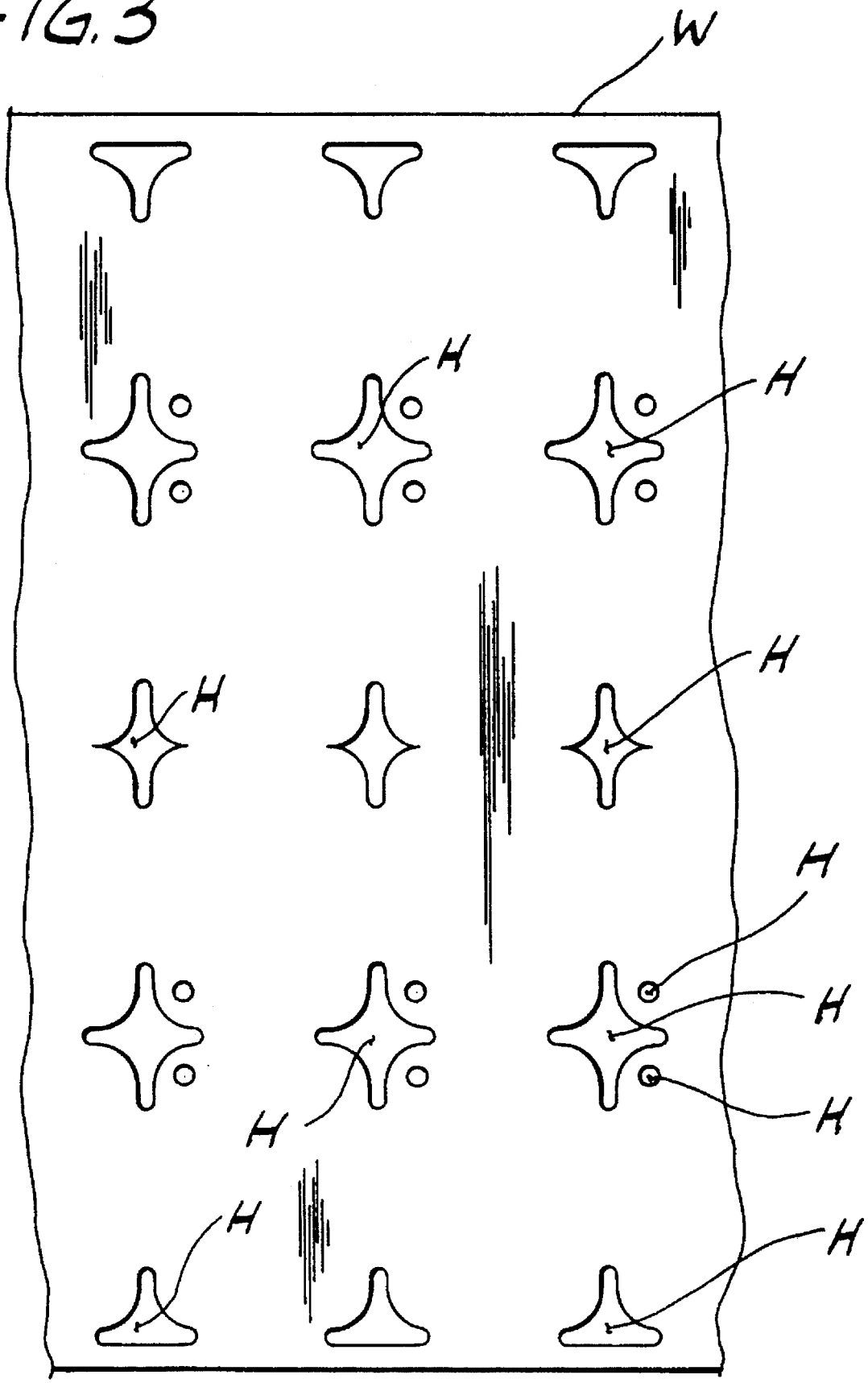
FIG. 3 is a view of a piece of web material after it has been cut by the die roll shown in FIG. 1.
Figure 4:
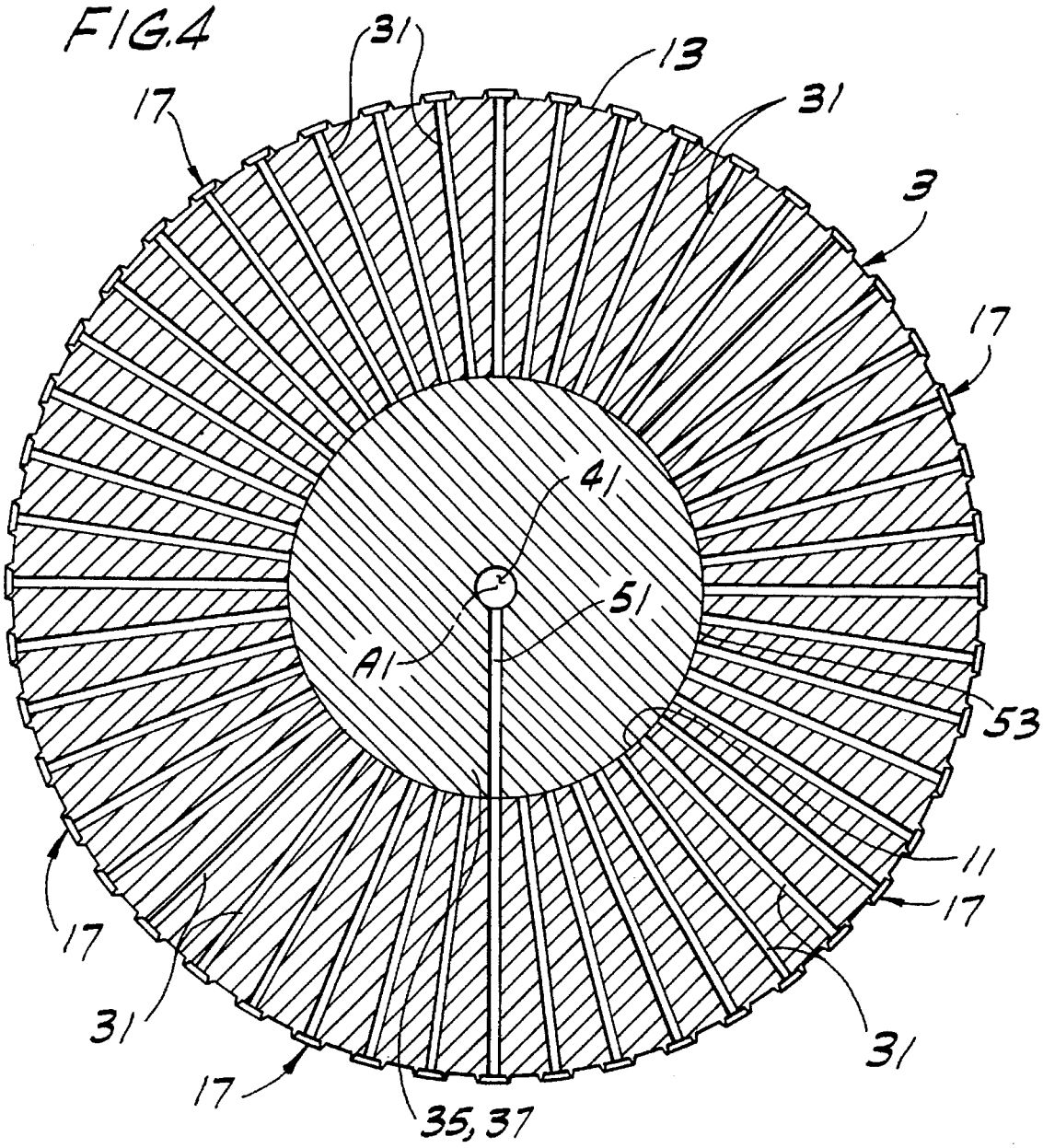
FIG. 4 is a vertical section taken along line 4—4 of FIG. 1.

Referring now to the drawings, and more particularly to FIG. 1, a die roll and air manifold system of the present invention is designated in its entirety by the reference numeral 1. The system is shown as comprising a rotary die roll, indicated generally at 3, and an air manifold system, indicated generally at 5, for the die roll. The die roll is mounted on the frame F of a press for rotation about a generally horizontal axis A1 coincident with the central longitudinal axis of the die roll. The die roll cooperates with a conventional anvil roll 7 journalled in bearing blocks 9 on the frame for rotation about an axis A2 parallel to axis A1 to die cut a web W of material fed between the two rolls, as will be understood by those skilled in this field. The web may be of label material, for example, and the die roll may be configured to cut a label pattern in the web (see FIG. 3). It will be understood, however, that this invention is applicable to die rolls having other cutting applications and configurations.

Figure 5:
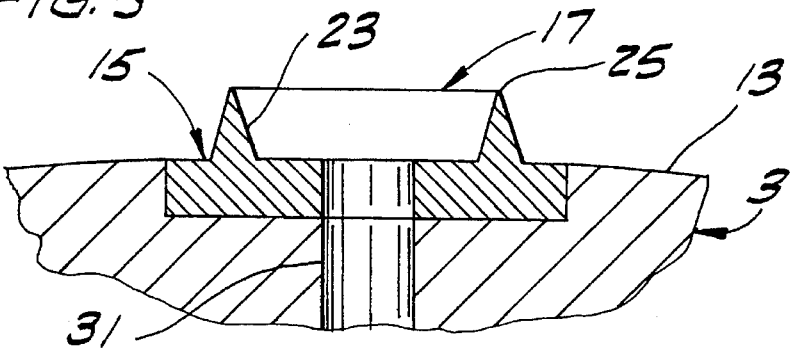
FIG. 5 is an enlarged view of a portion of FIG. 4 showing a cutting edge formation on the die roll.

The die roll 3 is a metal member machined to have a central cylindric bore 11 therein extending longitudinally of the die roll coaxial with axis A1, and a cylindric outer surface 13 concentric with the central bore, the outer surface being adapted for rolling engagement with the aforementioned web of material as it passes through the nip of the die and anvil rolls. A plurality of cutters, each generally designated 15 in FIG. 1, are located on the outer surface of the roll. Each of these cutters has a cutting edge formation (generally indicated at 17) defining a substantially closed loop for cutting out a piece of the web to be removed from the web as scrap (the hole in the web resulting from such removal being indicated at H in FIG. 3). As shown in FIG. 1, each cutter comprises a metal insert removably secured in a recess in the outer surface of the die roll by one or more fasteners 21 (e.g., set screws) to enable convenient repair and/or replacement of the cutter. Alternatively, each cutter can be formed (machined) as an integral part of the outer surface of the die roll. In either event, the closed-loop cutting edge formation 17 comprises a blade 23 having a sharp cutting edge 25 for making the appropriate cut in the web (see FIG. 5). The cutters 15 are positioned and arranged according to the pattern and repeat of the cuts to be made in the web. Typically, the cutters lie in a series of planes extending radially with respect to the die roll and spaced at intervals along the axis A1 of the die roll, the number of radial planes depending on the number of cuts to be made across the web at any given location, and the number of cutters in any given radial plane depending on the cut pattern and repeat.

A plurality of air outlet passages, each designated 31, are formed in the die roll 3 to extend generally radially outwardly from the central longitudinal bore 11 to locations on the outer surface 13 of the roll inside the substantially closed loops defined by the cutting edge formations 17 of respective cutters 15. One or more of these passages 31 is provided for each die cutter 15. Typically, therefore, the passages lie on the aforementioned radial planes spaced at intervals along axis A1 (see FIG. 1). As will be described in detail later in this specification, the purpose of these passages 31 is to provide for the flow of air under pressure from the air manifold outwardly through the passages to the cutters to eject pieces of scrap material from the cutters so they do not become clogged. The air outlet passages should be sized for this purpose. Passages having a diameter of 0.0625–0.093 in. have been found to be suitable.

The air manifold system 5 comprises an air manifold 35 having a cylindric body 37 positioned in the central bore 11 in the die roll. The cylindric body 37 has an outside diameter only slightly less than the diameter of the bore 11. A pair of shafts 39 extend coaxially from opposite ends of the cylindric body 37 beyond respective ends of the die roll for mounting of the air manifold and die roll on the press. As will be described in greater detail later in this specification, the air manifold 35 is held against rotation relative to the die roll 3, so that the die roll rotates on axis A1 relative to the air manifold.

The air manifold 35 has axial passaging therein comprising a single passage 41 of uniform diameter extending through the cylindric body 37 of the air manifold 35 and through its two shafts 39. One end of this passage constitutes an inlet which is threaded for receiving a fitting 43 connected to a source of pressurized air (not shown). The opposite end of the passage is plugged, as indicated at 45. A plurality of air outlet passages, each designated 51, extend radially from the axial passage 41 to the outer cylindric surface 53 of the body of the air manifold 37. These radial passages 51 are positioned in radial planes corresponding to the radial planes of the air outlet passages 31 in the die roll 3. There is at least one (and typically only one) air manifold outlet passage 51 in each radial plane containing air outlet passages 31 in the die roll, the arrangement being such that, as the die roll rotates relative to the air manifold, each air manifold outlet passage communicates for a short interval of time with each of the die roll air outlet passages located in the same radial plane. In this manner, at least one short burst of air is delivered to each air outlet passage 31 in the die roll during each revolution thereof. The diameters of the axial and radial passages 41, 51 in the air manifold should be appropriately sized, with the diameter of each air manifold outlet passage 51 being approximately the same as the diameter of each die roll outlet passage 31 (e.g., 0.0625–0.093 in.).

As already noted, it is preferable that the scrap material ejected from the cutters be blown outwardly in a controlled manner, i.e., in a predetermined direction. This can be accomplished in the present invention simply by holding the air manifold 35 in a fixed position in which its air outlet passages 51 are directed in the desired direction of ejection (e.g., generally downwardly as shown in FIG. 1). If it is important that the scrap be ejected only in a very specific direction, then it will be understood that there should be only one air outlet passage in the air manifold in any given radial plane, or only a few such air outlet passages closely spaced within a relatively small angular sector.

The cylindric body 37 and two shafts 39 of the air manifold 35 are preferably integrally formed (machined) from a single piece of metal, and the outside diameter of the body is only slightly less than diameter of the central bore 11 in the die roll. The cylindric outer surface 53 of the air manifold body and the surface of the bore 11 in the die roll are preferably machined surfaces so that there is a close tolerance fit therebetween. This fit should be sufficiently close (e.g., 0.001 in.) to prevent any substantial escape of air into the bore as the die roll rotates relative to the air manifold. This avoids an undesirable reduction of air pressure and ensures that the bursts of air delivered to the cutters 15 via the radial air outlet passages 31 are of sufficient strength to accomplish their intended purpose.

The air manifold system 5 also includes a pair of bearing assemblies, each generally designated 61, at opposite ends of the die roll 3 for mounting the air manifold 35 and die roll on a press. As illustrated in FIG. 1, the bearing assemblies 61 comprise a pair of circular bearers, each designated 63, removably fastened to opposite ends of the die roll by a plurality of screws 65, and a pair of tubular bearer shafts 67 extending outwardly (away from the die roll) from the bearers 63 coaxially with respect to the central axis A1 of the die roll. The ends of the bearer shafts 67 are journalled in mounting blocks 69 secured to the frame F of the press for conjoint rotation of the bearers and die roll about axis A1. The shafts 39 of the air manifold 35 extend coaxially inside the tubular bearer shafts 67. Suitable bearings 71 carried by the bearers 63 facilitate precise positioning and rotation of the bearers and die roll relative to the stationary air manifold. These bearings may be ball bearings, for example, received in raceways formed between the bearers 63 and respective air manifold shafts 39, each raceway having a radial outer surface 73 formed on a respective bearer and a radial inner surface 75 formed on a respective shaft immediately adjacent the body 37 of the air manifold 35. Other types of bearings may also be suitable.

Figure 2:
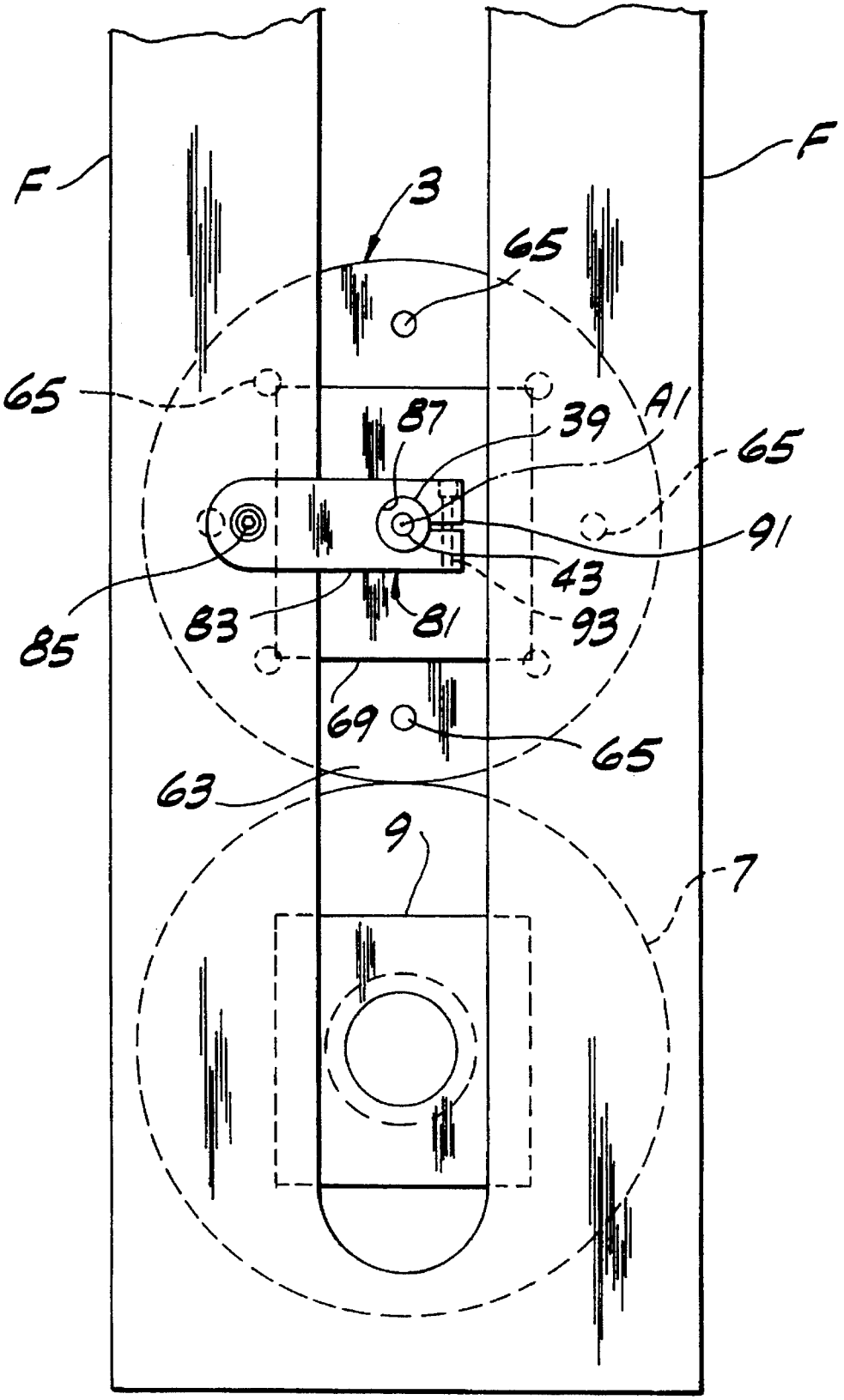
FIG. 2 is a right end elevational view of FIG. 1.

In the embodiment shown in FIG. 1, the shafts 39 of the air manifold are dimensioned to extend outwardly beyond the ends of the tubular bearer shafts 67. Means, indicated generally at 81 in FIG. 2, engageable with the protruding end of one of the shafts 39, holds the shaft (and the entire air manifold 35) against rotation. This means comprises an elongate clamping member 83 pivoted at one end at 85 on the frame F of the press for swinging about a generally horizontal axis. The clamping member 83 has a circular opening 87 adjacent its free (non-pivoted) end for receiving the end of the air manifold shaft 39, and a slot 91 which extends between the opening and the outer edge of the member. By tightening a screw 93 bridging the slot, the size of the circular opening 87 may be reduced so that the clamp member 83 clamps against the manifold shaft 39 and holds it stationary relative to the press frame F.

The die roll 3 and air manifold system 5 shown in the drawings is "reversible" in design, that is, the system is symmetric about the central radial plane of the die roll so that either bearer shaft 67 may be journalled at either side of the press frame F. It will be understood, however, that this symmetry is not critical to the present invention. For example, some presses will not accommodate a "reversible" design, in which case the construction of the air manifold shaft 39 and bearing assembly 61 at one end of the die roll will vary from the construction at the opposite end of the roll. For example, where there are space limitations at one side of the frame, the shafts 39, 67 at that side of the frame may need to be stub shafts.

The die and anvil rolls 3, 7 are driven by drive gearing on the press (not shown) in mesh with a gear 95 on the anvil roll, which is in mesh with a gear 97 on the die roll. The arrangement is such that both rolls rotate together to effect the cutting of a web of material fed between the two rolls.

The die roll and air manifold system 1 of the present invention is simple to assemble and to install. The air manifold 35 is simply inserted in bore 11 of the die roll 3 and the bearers 63 fastened to respective ends of the die roll with the shafts 39 of the air manifold extending outwardly through the tubular shafts 67 of the bearers. After the ends of the bearer shafts are journalled in the mounting blocks 69 and the mounting blocks installed on the press frame F in a position in which the gears 95, 97 of the die roll and anvil roll are in mesh, the clamping member 83 is tightened on the protruding end of one of the air manifold shafts 39 to hold the air manifold against rotation. The inlet of the axial passage 41 through the air manifold 35 is then connected to a source of air under pressure. Upon rotation of the die roll relative to the air manifold, the air outlet passages 31 in the die roll will move into intermittent alignment with the air outlet passages 51 in the air manifold to deliver intermittent short bursts of air to the cutters 15 to eject any scrap therefrom.

It is important to observe that one of the significant advantages of this invention is that the central bore 11 in the die roll may be made to be considerably larger in diameter (e.g., 0.625 in. or greater) than in prior systems where the shafts journalling the die roll in the press are formed as an integral part of the die roll. Because the diameter of the central bore 11 can be made greater, adjacent air outlet passages 31 in any given radial plane of the die roll may be spaced much closer together, which reduces the minimum spacing between adjacent cutters 15 on the surface of the die roll. As a result, a system of this invention is capable of cutting intricate patterns with short repeats.

Figure 6:
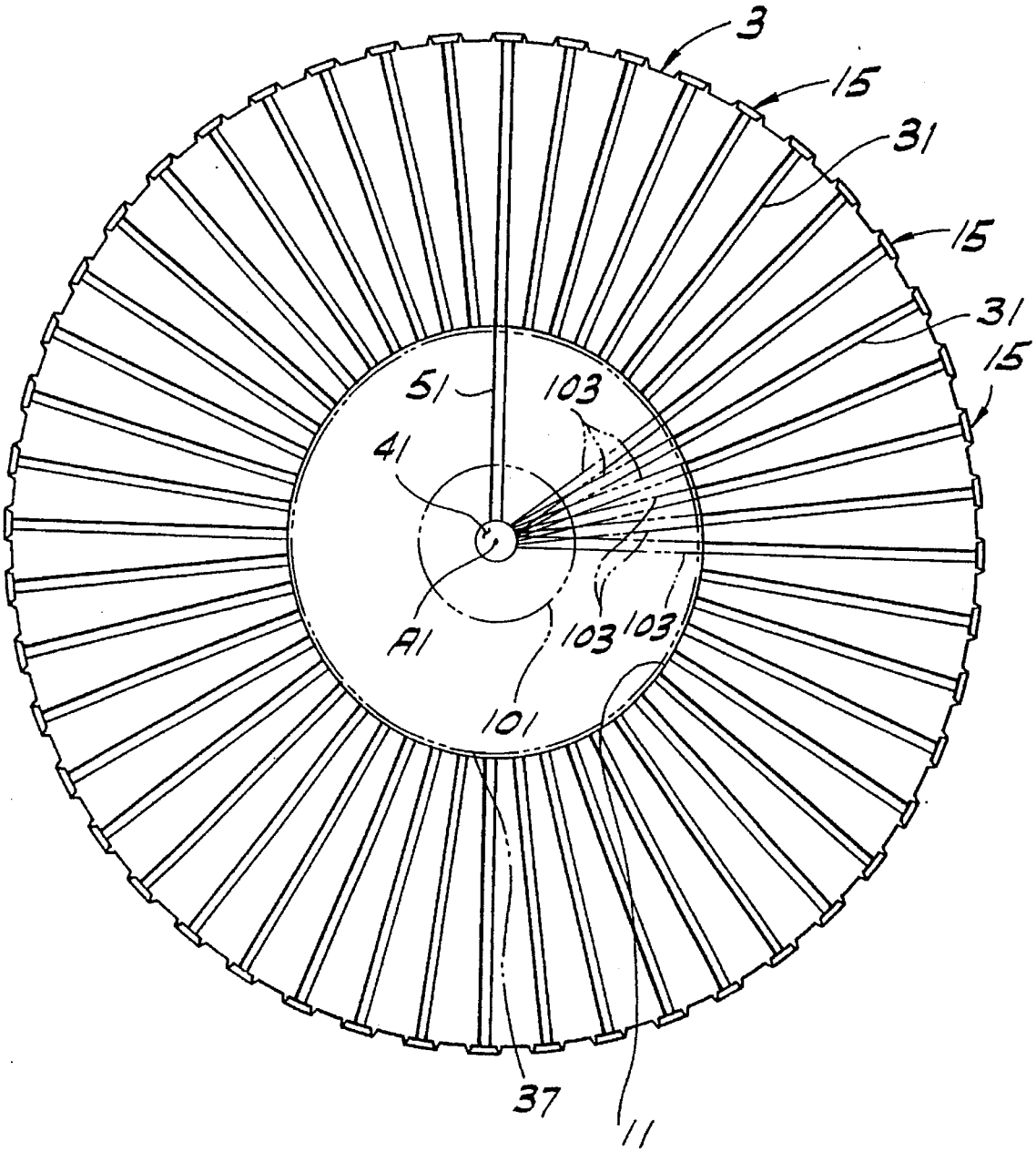
FIG. 6 a schematic sectional view through a die roll illustrating the benefits of the present invention.

FIG. 6 illustrates in greater detail the advantage of increasing the size of the bore in the die roll. It is a schematic view taken in a radial plane through a die roll 3 and air manifold 35 of the present invention. As depicted, there are 48 radial air outlet passages 31, the angular spacing between the centerlines of adjacent passages being approximately 7.5°. It will be noted that the inlet ends of these passages are spaced apart a significant distance where they intercept the central bore 11 in the die roll. Maintaining this separation is important. If adjacent air passages 31 intersect, or are spaced too closely together, air under pressure from the air manifold 35 will be introduced simultaneously into more than one passage at the same time, which not only reduces the force of the air bursts delivered to the respective cutters 15, but also expands the area or zone into which pieces of scrap are blown from the die. As will be observed, a desirable separation of the air passages 31 can be attained only if the diameter of the bore 11 in the die roll is greater than the phantom circle indicated at 101, where the projections 103 of the air passages 31 intersect. Unless the diameter of the bore 11 exceeds the diameter of this circle 101, the angular spacing between the air outlet passages must be increased (e.g., to greater than 7.5°) to attain the necessary separation. However, increasing this angular spacing also requires adjacent cutters 15 on the die roll to be spaced farther apart, since each cutter requires one or more air outlet passages 31. It will be understood, therefore, that increasing the size of the central bore 11 in the die roll, as permitted by this invention, enables the angular spacing between adjacent air outlet passages 31 to be reduced significantly. As a result, cutters 15 on the die roll may be spaced more closely together in the same radial plane.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A die roll and air manifold system, comprising a rotary die roll rotatable in a press about a central longitudinal axis, a central cylindric longitudinal bore through the die roll generally coaxial with said axis, said die roll having a generally cylindric outer surface concentric with said bore, said outer surface being adapted for rolling engagement with a web of material to be die cut, a plurality of cutters on the outer surface of the roll, each of said cutters having a cutting edge formation defining a substantially closed loop for cutting out a piece of the web to be removed from the web as scrap, air outlet passages in the die roll extending generally radially outwardly from said central longitudinal bore to locations on the outer surface of the roll inside the substantially closed loops defined by the cutting edge formations of respective cutters, an air manifold having a cylindric body positioned in the central bore in the die roll, said cylindric body having an outside diameter only slightly less than the diameter of the bore, and a pair of shafts extending coaxially from opposite ends of the cylindric body beyond respective ends of the die roll for mounting of the air manifold and die roll on a press, the die roll being rotatable relative to the air manifold, said manifold shafts having outside diameters less than the diameter of said central bore and less than the outside diameter of the cylindric body of the air manifold, axial passaging in the air manifold extending generally axially of the manifold, said passaging having an inlet adapted for connection to a source of pressurized air, one or more air outlet passages in the body of the air manifold extending from said axial passaging to the outer surface of the manifold body, said air outlet passages being positioned for intermittent alignment with each of said air outlet passages in the die roll as the roll rotates relative to the air manifold thereby to effect the intermittent delivery of bursts of pressurized air through the air outlet passages in the die roll, said bursts of air serving to eject said scrap pieces of web from the cutters, and a pair of bearing assemblies at opposite ends of the die roll for mounting the air manifold and die roll on a press, said bearing assemblies comprising a pair of bearers removably fastened to opposite ends of the die roll, and a pair of bearer shafts extending from the bearers coaxially with respect to the central axis of the die roll, said bearer shafts being adapted to be journalled in the press for conjoint rotation of the bearers and die roll about said central axis, and bearings carried by the bearers supporting the shafts of the air manifold for relative rotation between the shafts and the bearers, at least one shaft of the air manifold being adapted to be held against rotation as the die roll rotates.

2. A die roll and air manifold system as set forth in claim 1 wherein said air manifold body and shafts are integrally formed as one piece.

3. A die roll and air manifold system as set forth in claim 2 wherein said axial passaging in the air manifold comprises a single air passage of generally uniform diameter extending the entire length of at least one of the shafts of the air manifold and substantially the entire length of the body of the air manifold.

4. A die roll and air manifold system as set forth in claim 1 wherein the outside surface of said cylindric body of the air manifold and the inside surface of the central bore in the die roll are machined surfaces, and wherein the cylindric body has a close tolerance fit in the bore sufficient to substantially eliminate escape of air from the air manifold into the bore of the die roll as the die roll rotates relative to the air manifold.

5. A die roll and air manifold system as set forth in claim 1 wherein the bearer shafts are tubular and receive the air manifold shafts therein, at least one air manifold shaft extending beyond a respective bearer shaft for engagement by means for holding the manifold against rotation.

6. A die roll and air manifold system as set forth in claim 1 wherein said die roll has a plurality of said air outlet passages therein at each of a plurality of locations spaced at intervals along the length of the roll, and wherein the cylindric body of the air manifold has corresponding air outlet passages therein adapted to register with the outlet air passages in the die roll as the die roll rotates relative to the air manifold.

7. A die roll and air manifold system as set forth in claim 6 wherein each of said locations lies in a radial plane of the die roll, and wherein adjacent air outlet passages in the die roll in any of said radial planes have a minimum spacing of 0.025 in. where the adjacent passages meet the central bore in the die roll.

8. An air manifold system for a rotary die roll rotatable about a central longitudinal axis, said die roll having a central cylindric longitudinal bore generally coaxial with said axis, a generally cylindric outer surface concentric with said bore adapted for rolling engagement with a web of material to be die cut, a plurality of cutters on the outer surface of the roll, each cutter having a cutting edge formation defining a substantially closed loop for cutting out a piece of the web to be removed from the web as scrap, and a plurality of air outlet passages in the die roll extending generally radially outwardly from said central longitudinal bore to locations on the outer surface of the roll inside the substantially closed loops defined by the cutting edge formations of respective cutters, said air manifold system comprising an air manifold having a cylindric body adapted to be positioned in the central bore in the die roll, a pair of manifold shafts coaxial with said cylindric body extending from opposite ends of the body for mounting of the air manifold and die roll on a press for rotation of the die roll relative to the air manifold about said axis, said manifold shafts having outside diameters less than the outside diameter of the cylindric body of the air manifold, axial passaging in the air manifold extending generally axially of the manifold, said passaging having an inlet adapted for connection to a source of pressurized air, one or more air outlet passages in the body of the air manifold extending from said axial passaging to the outer surface of the manifold body whereby when the cylindric body of the air manifold is positioned in the central bore in the die roll, and when the die roll is rotated relative to the air manifold, the air outlet passages in the air manifold are adapted intermittently to move into alignment with the air outlet passages in the die roll to effect the intermittent delivery of bursts of pressurized air through said air outlet passages in the die roll, said bursts of air serving to eject said scrap pieces of web from the cutters, and a pair of bearing assemblies at opposite ends of the air manifold for mounting the air manifold and die roll on a press, said bearing assemblies comprising a pair of bearers adapted to be removably fastened to opposite ends of the die roll, and a pair of bearer shafts extending from the bearers coaxially with respect to the air manifold, said bearer shafts being adapted to be journalled in the press for conjoint rotation of the bearers and die roll, and bearings carried by the bearers supporting the shafts of the air manifold for relative rotation between the shafts and the bearers, at least one shaft of the air manifold being adapted to be held against rotation as the die roll rotates.

9. An air manifold system as set forth in claim 8 wherein said air manifold body and shafts are integrally formed as one piece.

10. An air manifold system as set forth in claim 9 wherein said axial passaging in the air manifold comprises a single air passage of generally uniform diameter extending the entire length of at least one of the shafts of the air manifold and substantially the entire length of the body of the air manifold.

11. An air manifold system as set forth in claim 8 wherein the bearer shafts are tubular and receive the air manifold shafts therein, at least one air manifold shaft being dimensioned to extend beyond a respective bearer shaft for engagement by means for holding the manifold against rotation.

12. An air manifold system as set forth in claim 8 wherein said body of the air manifold has a plurality of said air outlet passages therein at each of plurality of locations spaced at intervals along the length of the body, and wherein each of said outlet passages extends radially with respect to the cylindric body.

13. An air manifold system as set forth in claim 12 wherein the outside diameter of the body of the air manifold is at least 0.625 in. or greater.

* * * * *